US010085542B2

(12) United States Patent
Piscopo

(10) Patent No.: US 10,085,542 B2
(45) Date of Patent: Oct. 2, 2018

(54) SOLID STICK APPLICATORS AND METHODS

(71) Applicant: Plastek Industries, Inc., Erie, PA (US)

(72) Inventor: Peter A. Piscopo, Medford, NJ (US)

(73) Assignee: Plastek Industries, Inc., Erie, PA (US)

( * ) Notice: Subject to any disclaimer, the term of this patent is extended or adjusted under 35 U.S.C. 154(b) by 0 days.

(21) Appl. No.: 15/416,449

(22) Filed: Jan. 26, 2017

(65) Prior Publication Data

US 2017/0135459 A1 May 18, 2017

Related U.S. Application Data

(63) Continuation of application No. 14/203,906, filed on Mar. 11, 2014, now Pat. No. 9,554,636.

(60) Provisional application No. 61/789,044, filed on Mar. 15, 2013.

(51) Int. Cl.
*A45D 40/06* (2006.01)
*A45D 40/04* (2006.01)

(52) U.S. Cl.
CPC ..... *A45D 40/06* (2013.01); *A45D 40/04* (2013.01)

(58) Field of Classification Search
CPC ..... A45D 40/04
USPC .... 215/254–256; 222/153.05–153.07, 541.1, 222/541.6, 541.9; 401/68, 98, 133, 134
See application file for complete search history.

(56) References Cited

U.S. PATENT DOCUMENTS

| | | | | |
|---|---|---|---|---|
| 4,932,803 | A | 6/1990 | Goldberger et al. | |
| 5,538,161 | A | 7/1996 | Koehler et al. | |
| 5,660,302 | A | 8/1997 | Trout | |
| 5,799,813 | A | 9/1998 | Letica | |
| D414,690 | S | 10/1999 | Hutchinson et al. | |
| D415,020 | S | 10/1999 | Hutchinson et al. | |
| D415,021 | S | 10/1999 | Hutchinson et al. | |
| 6,039,483 | A | 3/2000 | Szekely | |
| 6,419,412 | B1 | 7/2002 | Ostrowski et al. | |
| 7,354,215 | B2 | 4/2008 | Rego et al. | |
| 7,488,129 | B1 | 2/2009 | Prischak | |
| 8,096,724 | B2 | 1/2012 | Bolander et al. | |
| 2007/0114142 | A1 | 5/2007 | Sine et al. | |
| 2007/0172304 | A1 | 7/2007 | Bolander et al. | |
| 2007/0177929 | A1* | 8/2007 | Yuhas | A45D 34/04 401/262 |
| 2008/0187390 | A1 | 8/2008 | Rego et al. | |

OTHER PUBLICATIONS

U.S. Office Action dated Feb. 23, 2016 for U.S. Appl. No. 14/203,906.

* cited by examiner

*Primary Examiner* — David Walczak
*Assistant Examiner* — Joshua Wiljanen
(74) *Attorney, Agent, or Firm* — Bachman & LaPointe, P.C.

(57) ABSTRACT

A dispenser has a barrel having: a bottom end; a top end; an inner wall; and an outer wall. A platform is upwardly moveable within the barrel inner wall from a first position to a second position. A screw member is coupled to the platform to shift the platform upward. A threaded first portion is engaged to the platform for relative rotation about a first axis and a second portion. A cap has a first condition mounted at the barrel top end and a removed condition. The barrel outer wall has an aperture and in the first condition the cap covers the aperture.

21 Claims, 15 Drawing Sheets

SOLID STICK APPLICATORS AND METHODS

CROSS-REFERENCE TO RELATED APPLICATIONS

This is a continuation of U.S. patent application Ser. No 14/203,906, filed Mar. 11, 2014, and entitled "Solid Stick Applicators and Methods", now U.S. Pat. No. 9,554,636, which claims benefit of U.S. Patent Application Ser. No. 61/789,044, filed Mar. 15, 2013, and entitled "Solid Stick Applicators and Methods", the disclosures of which applications are incorporated by reference herein in their entireties as if set forth at length.

BACKGROUND OF THE INVENTION

The invention relates to personal care. More particularly, the invention relates to applicators for underarm antiperspirant and/or deodorant.

A well-developed art exists regarding dispenser/applicators for personal care products. One particular area involves applicators for solid or gel antiperspirant and/or deodorant compositions. Applicators for solid and gel compositions are typically generally similar to each other, with a piston (platform) upwardly movable within a cylinder (barrel) to progressively drive the composition out the barrel upper end.

Due to the relative lack of stiffness of many gels and soft solids, dispensers for such compositions commonly include apertured applicator elements across the upper end of the barrel. Many solid products, instead have a removable molded seal inserted within the upper end. In manufacture, the seal may serve to mold the composition during a bottom fill operation. At the first use of the product, the end user extracts and discards the seal exposing the upper end of the composition. As molded by the seal, the upper end may have an ergonomically or ornamentally advantageous shape.

Dispenser/applicators are disclosed in U.S. Pat. No. 8,096,724 (the '724 patent) entitled "Package for Merchandising Consumer Care Products", U.S. Pat. No. 7,488,129 (the '129 patent) entitled "Seal for Applicator for Personal Care Compositions", U.S. Pat. No. 7,354,215 (the '215 patent) entitled "Dispensing Package for a Cosmetic/Antiperspirant/Deodorant or Other Stick Product", U.S. Pat. No. 6,419,412 (the '412 patent) entitled "Positively Sealed Cosmetic Dispenser", U.S. Pat. No. 6,039,483 (the '483 patent) entitled "Rotary Dispenser", U.S. Pat. No. 5,538,161 (the '161 patent) entitled "Container Having Content Level Indicator", and U.S. Pat. No. 4,932,803 (the '803 patent), entitled "Stick Dispenser", and U.S. Patent Application Publication Nos. 2007/0172304 (the '304 publication) entitled "Package for Merchandising Consumer Care Products" and 2007/0114142 (the '142 publication) entitled "Container with Perfuming Means".

SUMMARY OF THE INVENTION

One aspect of the disclosure involves a dispenser having a barrel, a piston upwardly movable within the barrel from a first position to a second position, and a body of personal care composition at least partially within the barrel between the piston and the barrel top end. An actuator is coupled to the piston to shift the piston upward (toward the top end). The actuator comprises a screw member having a threaded portion engaged to the piston for relative rotation about a first axis. A cap has a first condition mounted at the barrel top end. The cap is removable from the first condition. An upper portion of the barrel has a rim portion, a dome, a breakaway connection between the dome and the rim portion recessed below the rim, and a handle coupled to the dome to allow pulling of the handle to sever the breakaway connection to remove the dome from the rim portion. The recessing provides a comfort edge to the user.

In another aspect, an upper portion of the barrel contains an aperture covered by the cap in the first condition. The aperture may provide a scent preview. This aspect may be practiced independently of the other aspects. For example, a plug seal or foil seal may be used instead of having a tearaway dome.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
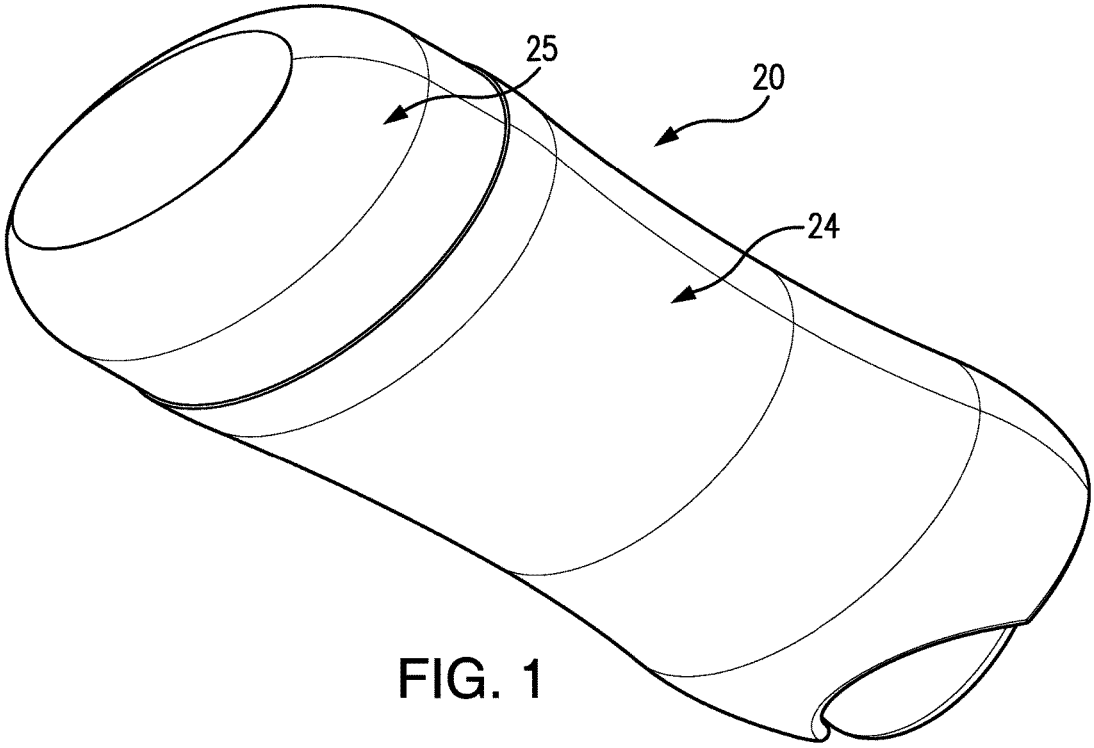
FIG. 1 is a view of a personal care product dispenser.
Figure 2:
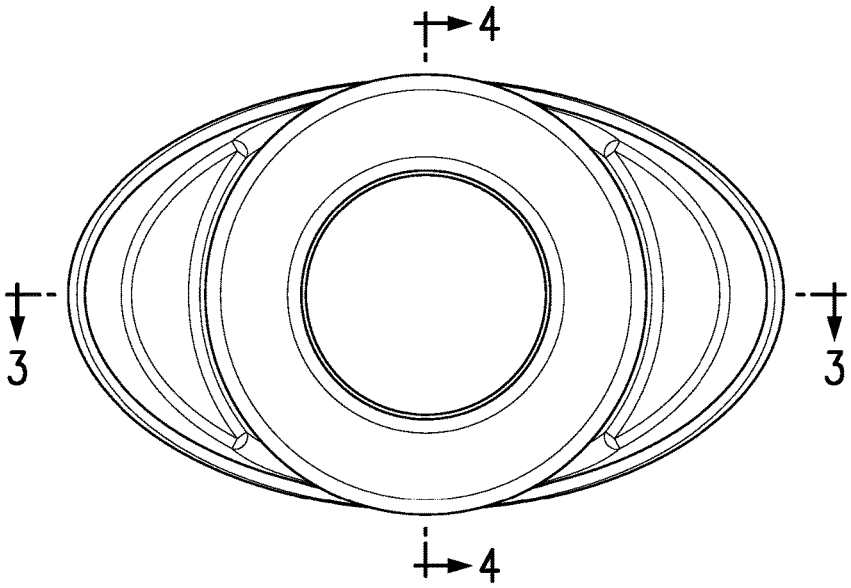
FIG. 2 is a bottom view of the dispenser of FIG. 1.
Figure 3:
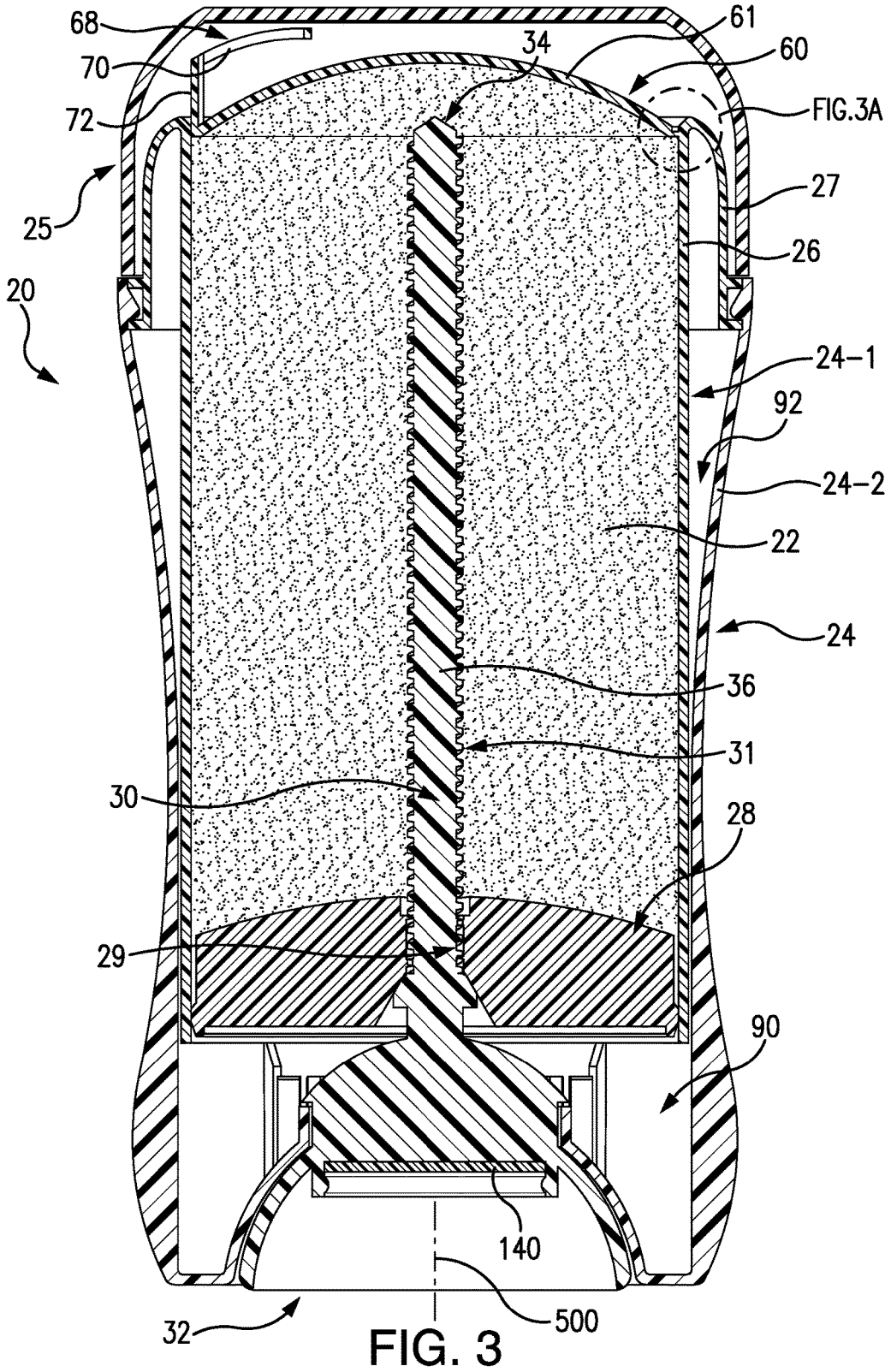
FIG. 3 is a central longitudinal/vertical sectional view of the dispenser taken along line 3-3 of FIG. 2.

FIG. 1 shows a dispenser 20 (often referred to as an applicator) for a personal care product 22 (FIG. 3; e.g., a cream, gel, or soft/semi-solid antiperspirant and/or deodorant). The dispenser 20 includes an inner body 24 (often identified as a barrel) containing the product 22. The exemplary barrel is formed as a two piece molding of an inner barrel 24-1 and outer barrel 24-2. A cap 25 may mount to the body. The inner barrel carries (within a sidewall 26; an outer sidewall being shown as 27) a platform or piston 28 (having an internal thread 29—FIG. 3) and an elevator screw member 30 (having an external thread 31 along the shaft 36 of the screw) for raising the platform to eject the product.

Figure 14:
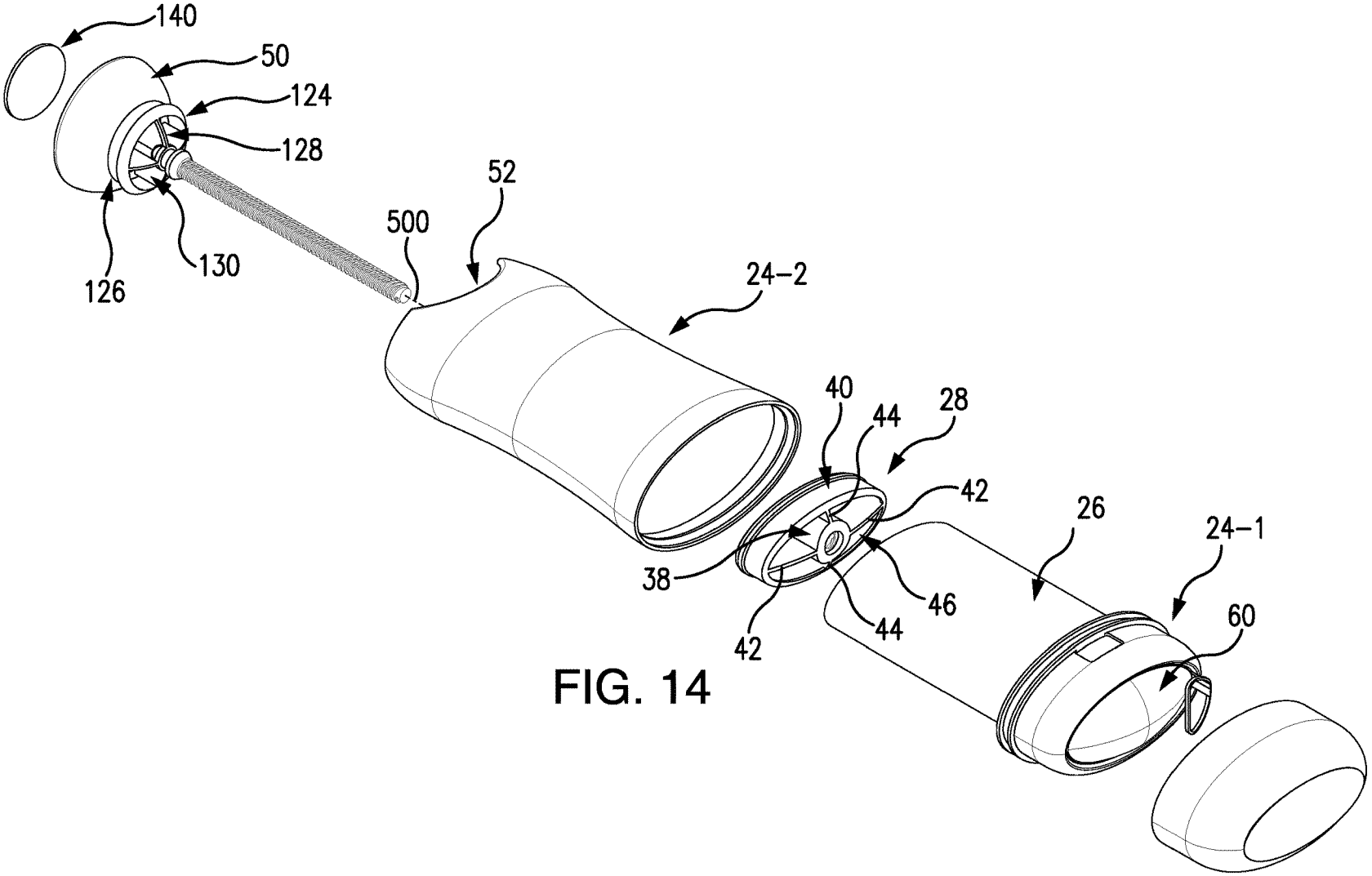
FIG. 14 is a first exploded view of the dispenser without personal care composition.
Figure 15:
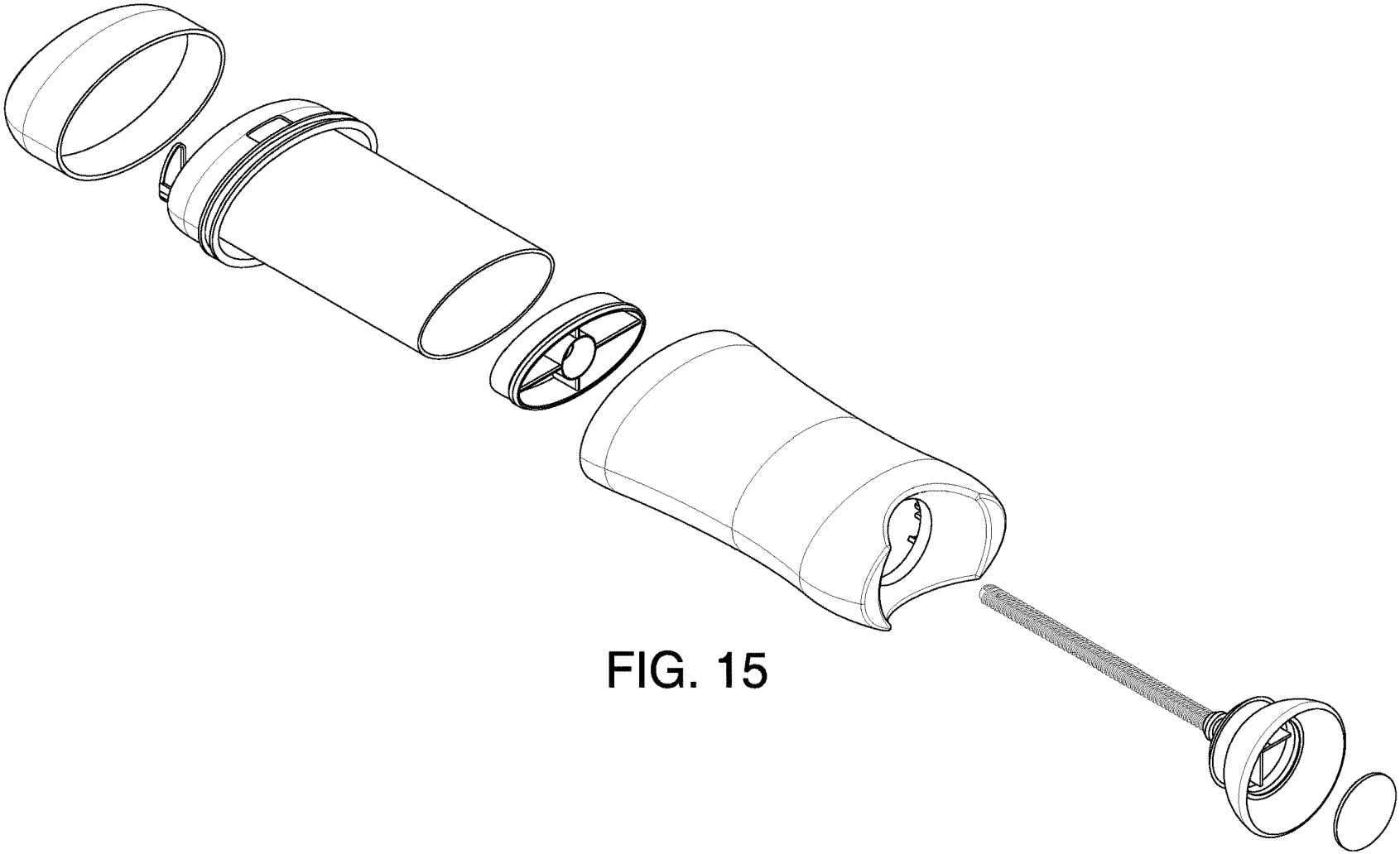
FIG. 15 is a second exploded view of the dispenser without personal care composition.

The exemplary screw member extends from a lower/bottom end 32 to an upper/top end 34. The exemplary screw has an externally threaded 31 upper portion forming the shaft 36 engaged to a complementary internally threaded 29 central portion 38 (shown in FIG. 14 as a central boss) of the platform 28. The screw has an axis of rotation 500 which forms a central longitudinal/vertical axis of the dispenser. FIG. 14 also shows a perimeter portion 44 of the platform and webs 42, 44 extending radially from the boss 38 to the perimeter portion 40 and leaving gaps or holes or apertures 46 axially through the platform. The outer surface of the perimeter portion 40 is received within the inner surface of the inner sidewall 26.

The screw member includes an approximately hemispherical actuator wheel or knob 50 (e.g., unitarily formed with the screw member threaded portion). The knob fits within a compartment 52 in the lower end of the outer barrel and protrudes slightly (FIG. 4) from lateral openings along the sides (long faces) of the barrel for easy adjustment.

Figure 3A:
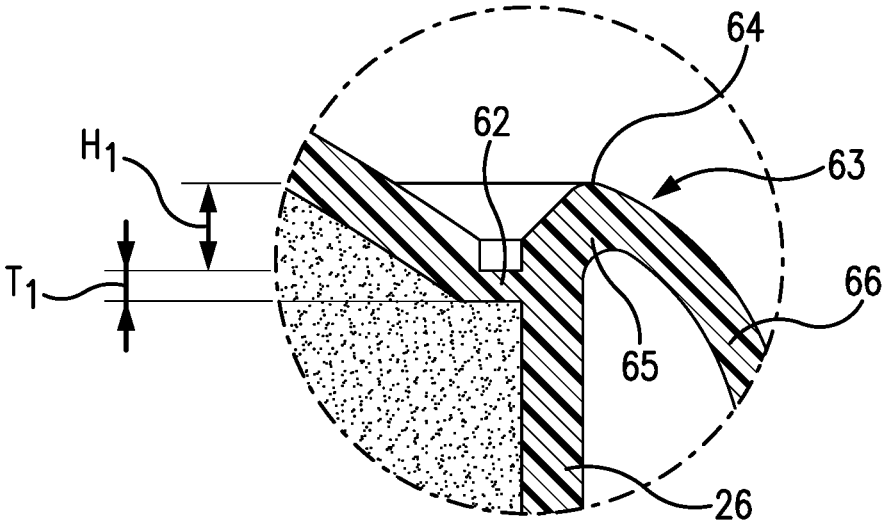
FIG. 3A is an enlarged view of a rim portion of a body of the dispenser.
Figure 8:
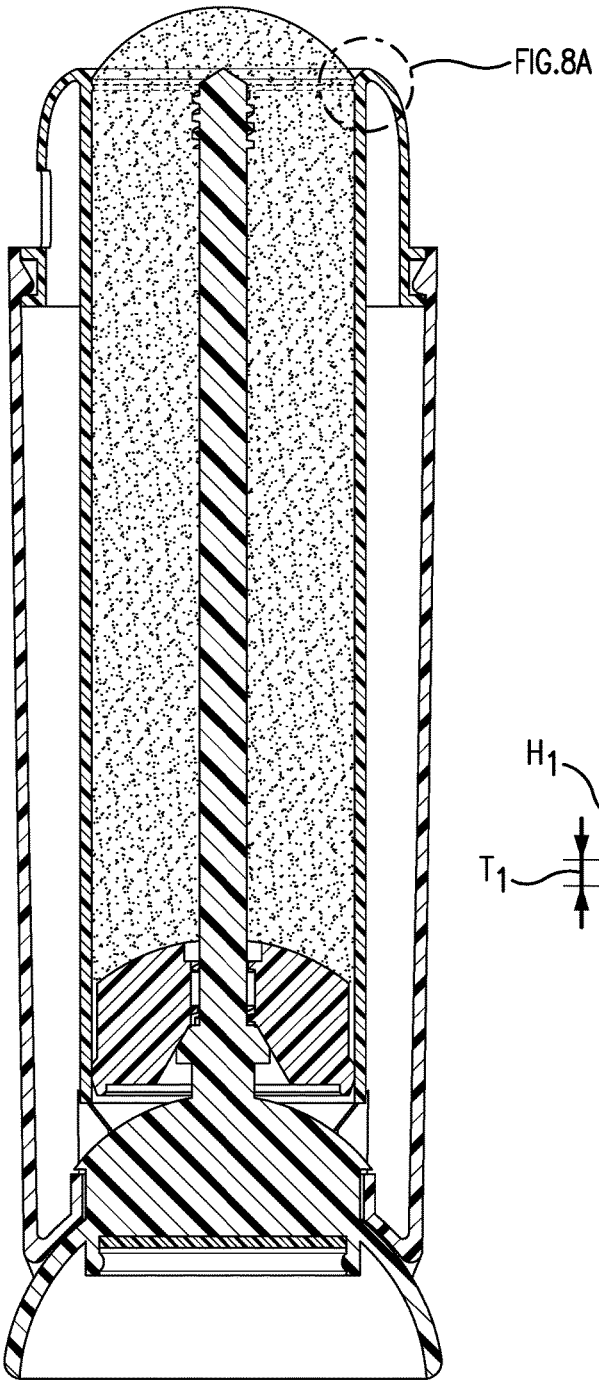
FIG. 8 is a central longitudinal/vertical sectional view of the dispenser with cap and dome removed.
Figure 8A:
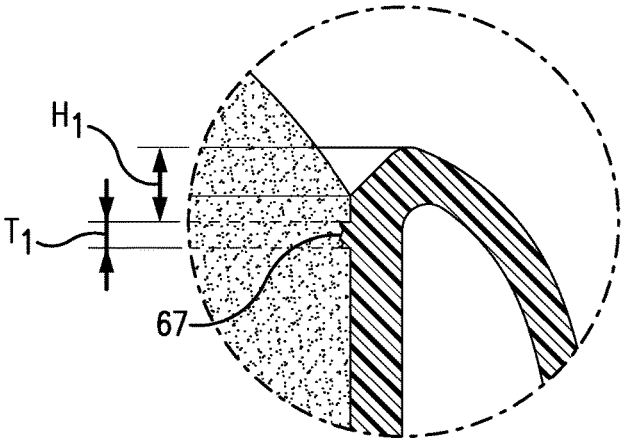
FIG. 8A is an enlarged view of a rim portion of the dispenser of FIG. 8.

The exemplary cap and barrel are near elliptical in cross-section or footprint. The inner barrel 24-1 (FIG. 14) is pre-molded with a tearaway dome 60 (FIG. 3) having a main body 61. A thin tearaway joint 62 (breakaway connection) (FIG. 3A) between the dome and the remainder of the inner barrel 24-1 is vertically recessed relative to a rim 64 of a rim portion 63 formed by the junction 65 of the inner barrel inner sidewall 26 and an inner barrel outer sidewall 66. Exemplary recessing $H_1$ of the upper edge of the tearaway joint is at least 0.5 mm. When torn away to leave a central dispensing aperture through which to dispense the product, the torn edge 67 (FIG. 8A) of a small remainder of the tearaway joint may be vertically recessed (by said $H_1$) to not abrade the user's skin. Exemplary recessing $H_1$ is 0.06 inch (1.5 mm). An exemplary range of recessing $H_1$ is at least 1 mm, more narrowly, 1.2-2.0 mm or 1.2-5.0 mm. The exemplary breakaway region may have a thickness $T_1$ less than the thickness of adjacent dome or sidewall material. The exemplary tearaway joint is along a cylindrical portion of the inner sidewall 26 near the extreme upper end thereof. The exemplary tearaway dome 60 has a user-engagable member 68 to facilitate tear-away of the dome. The exemplary member 68 is a pull ring comprising a ring portion 70 and a vertical tab 72 extending upward from the main body 61 (e.g., at a perimeter portion adjacent the tearaway joint). In this example, the tab 72 is at one of the more distant two ends of the generally elliptical cross-section.

Figure 4:
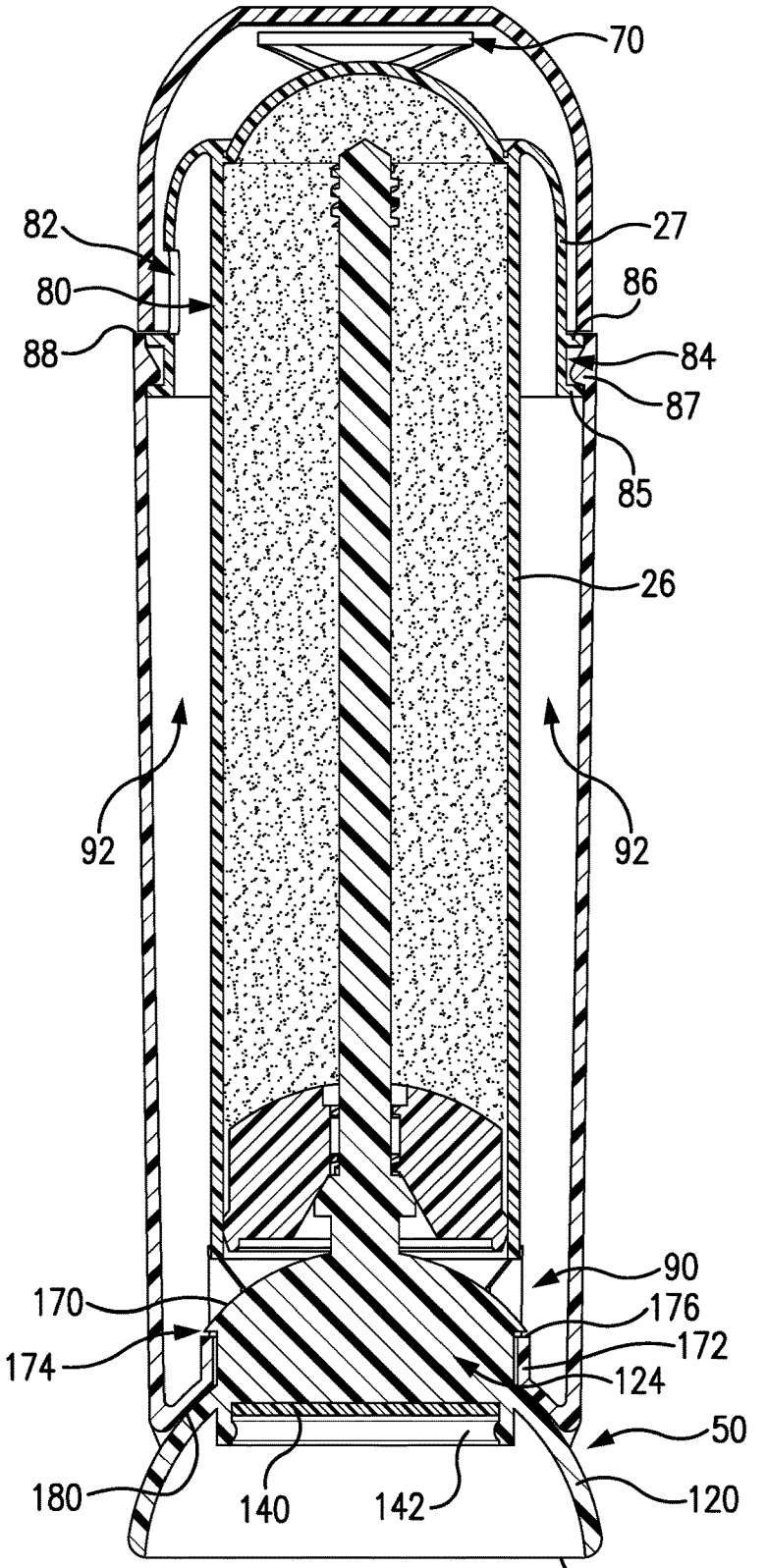
FIG. 4 is a central longitudinal/vertical sectional view of the dispenser taken along line 4-4 of FIG. 2.
Figure 5:
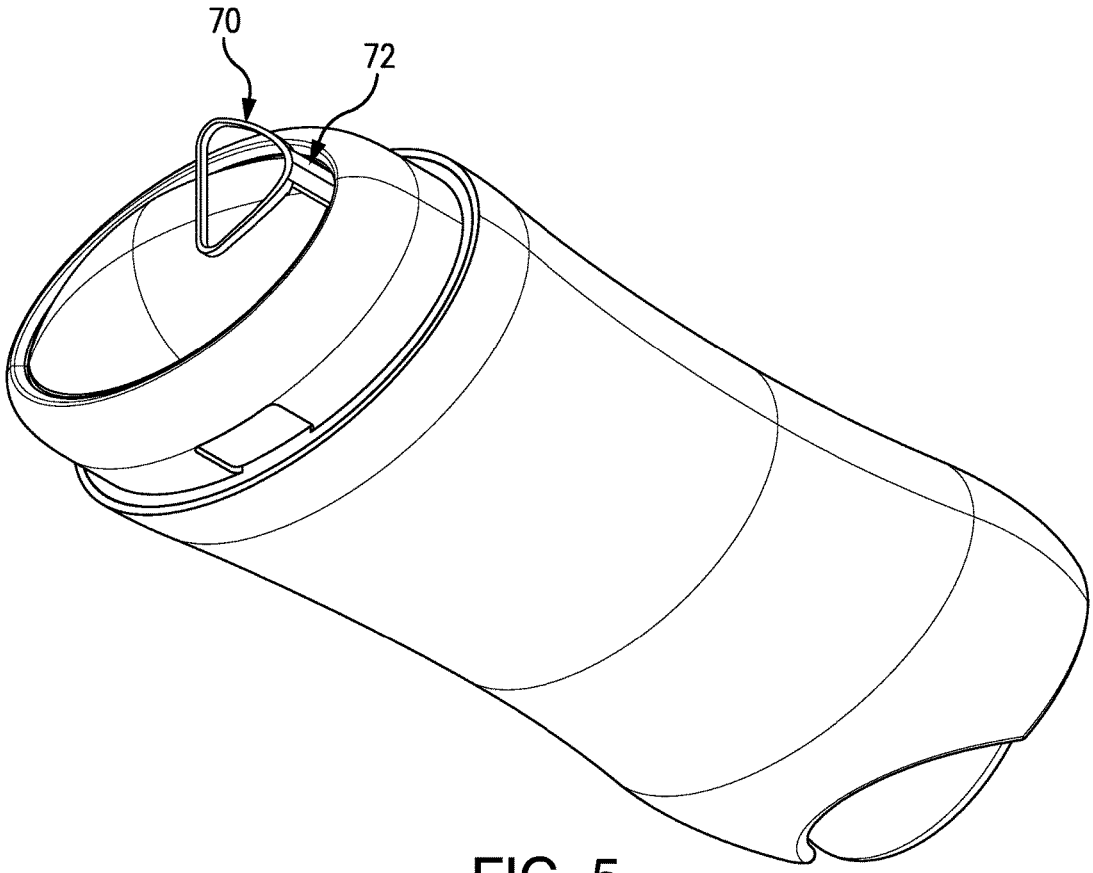
FIG. 5 is a view of the dispenser with cap removed.
Figure 6:
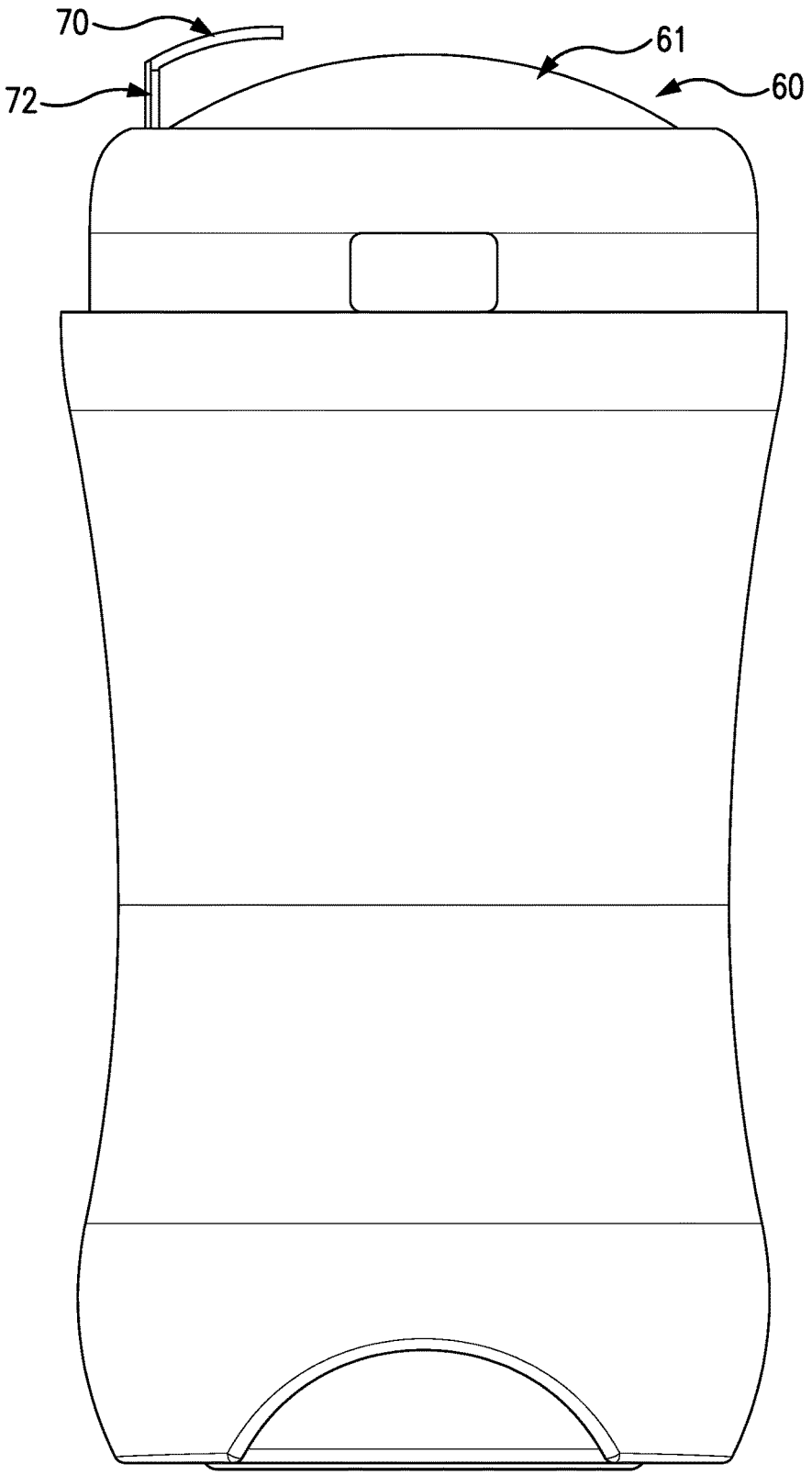
FIG. 6 is a front view of the dispenser of FIG. 5.
Figure 7:
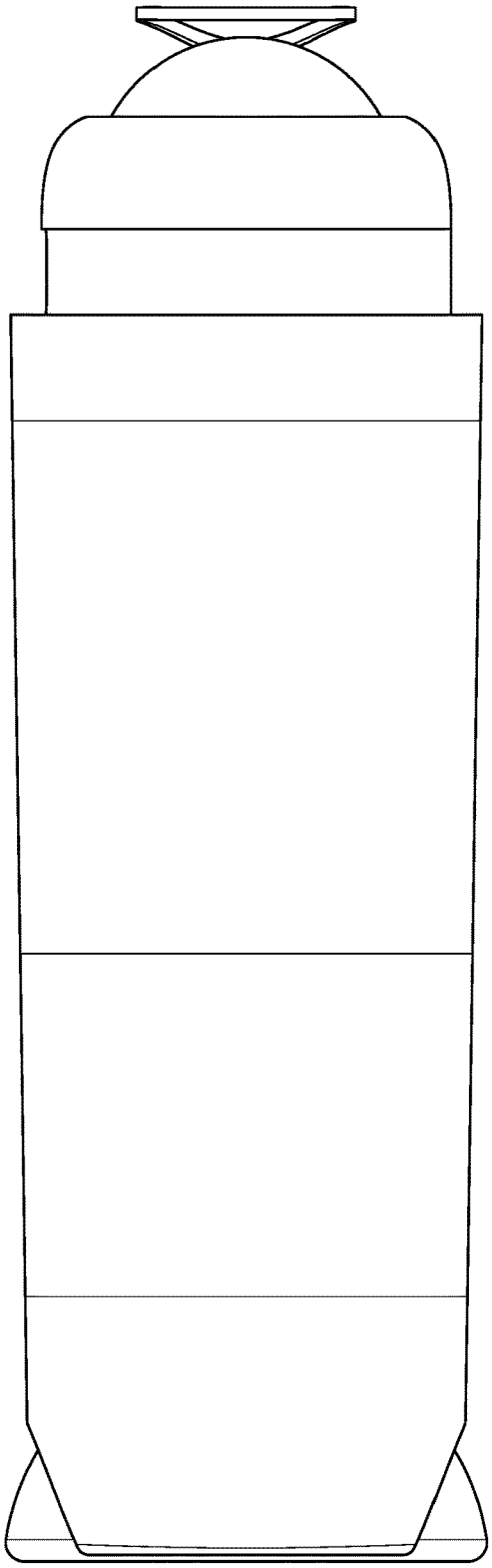
FIG. 7 is a side view of the dispenser of FIG. 5.

The exemplary inner barrel has at least a translucent portion 80 (FIG. 4). For example, the entire inner barrel may be translucent or just a local portion may be. An outer wall of either the inner barrel or the outer barrel may have an aperture or window 82 through which this portion 80 is visible (when the cap is removed) so as at least to provide a visual indication of whether the product is nearly used up. This visibility, accordingly, may occur at least within a last interval (e.g., uppermost 10%) of the platform's range of travel. In the exemplary embodiment, the outer sidewall 27 of the barrel is formed by the combination of the inner barrel outer sidewall 66 and the outer barrel. In this example, the window is thus in the inner barrel outer sidewall 66. The exemplary window is at least 3 mm high and at least 3 mm wide and/or at least 20 $mm^2$.

In this exemplary configuration, to attain the inner barrel to the outer barrel, the two have interfitting features. An exemplary set of interfitting features comprises an outwardly open channel 84 circumscribing the inner barrel outer sidewall 27 at a bottom rim thereof and having a pair of radially protruding flanges 85, 86 forming sides of the channel. This engages a complementary barb 87 in the outer barrel at an upper rim 88 thereof.

By having a single-piece molded inner barrel include both the inner sidewall 26 for receiving the platform and an upper sidewall 27 along at least an upper portion of the body, a smooth contour can be provided for user comfort. The junction between the inner and outer barrels can thus be kept away from contact with the user's skin.

Figure 9:
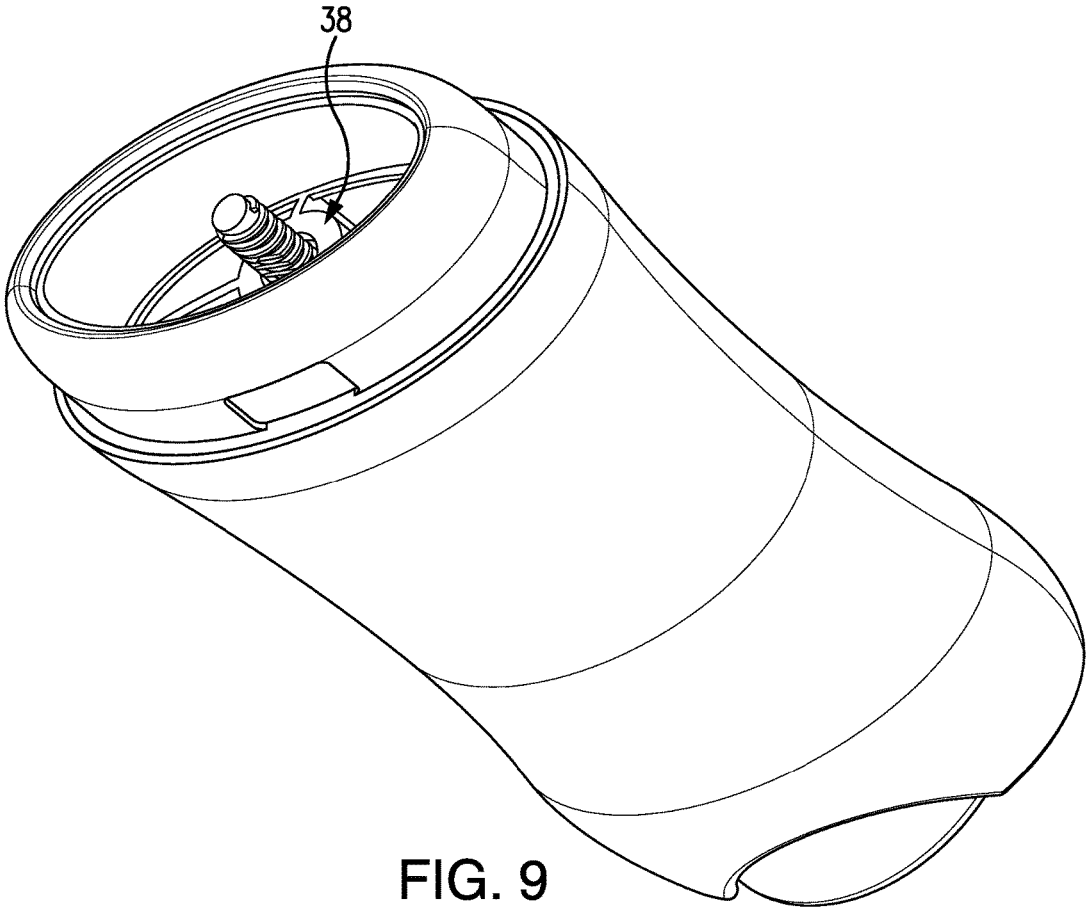
FIG. 9 is a view of the dispenser with cap and dome removed and personal care composition removed so as to show positioning of a platform at an intermediate stage of elevation.
Figure 10:
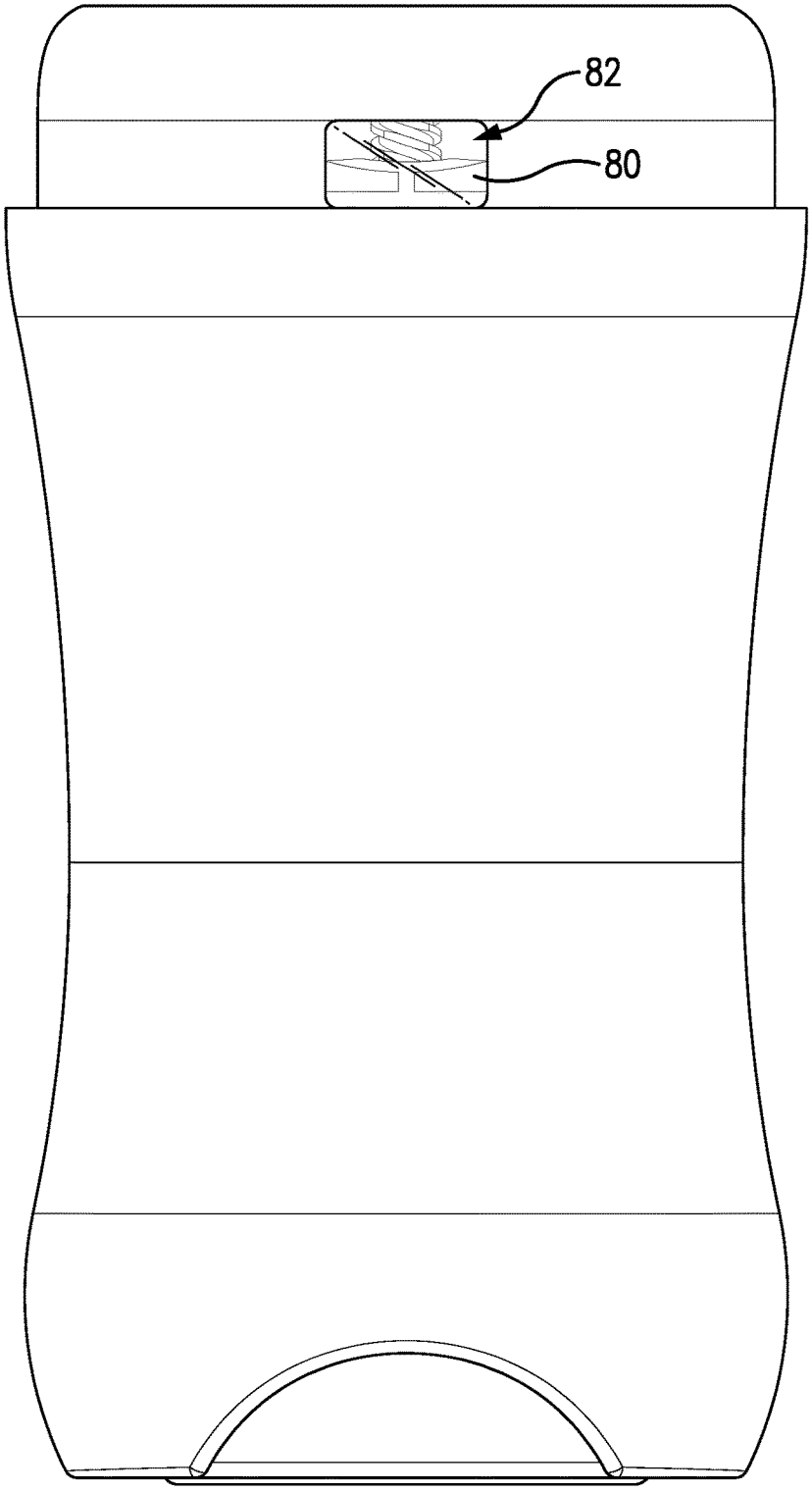
FIG. 10 is a front view of the dispenser of FIG. 9.
Figure 11:
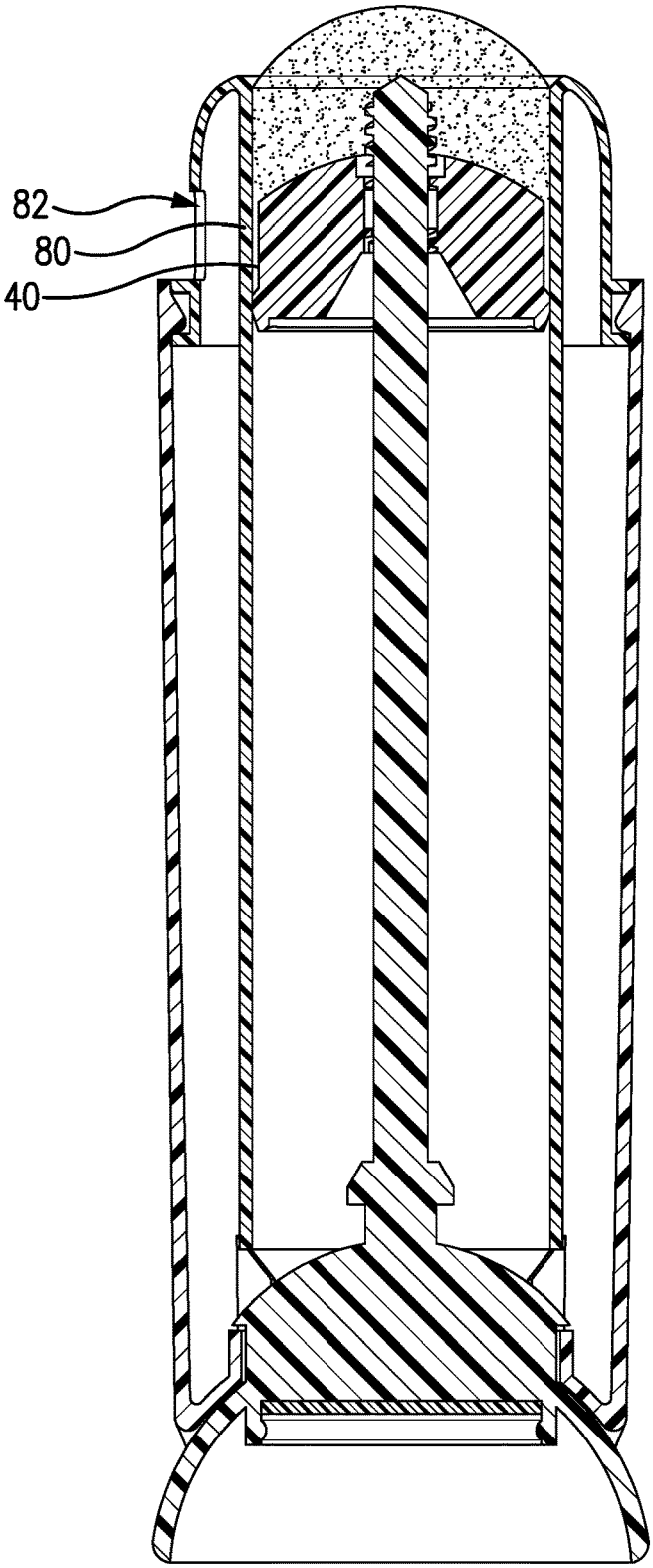
FIG. 11 is a central longitudinal/vertical sectional view of the dispenser in a near-final stage of use showing the platform at even level with a window.

Accordingly, for most of the range of motion of the platform only the personal care composition 22 will be visible through the window 82 and its associated translucent or transparent portion of the barrel. In the exemplary embodiment, eventually a portion of the platform will come into view through the window 82 and thereby provide indication of near expenditure of product. For example, FIGS. 9 and 10 show a situation wherein the platform has proceeded to occupy about half the vertical span of the window 82. FIG. 11 shows a subsequent stage wherein the platform nearly completely fills the view through the window. A subsequent raising may cause the platform to finally completely fill the view through the window.

The window 82 may also provide a scent preview feature. For example, aroma from the product may waft through the openings 46 in the platform and into a lower portion 90 of the barrel interior and up into the space 92 between the inner wall and outer wall and be vented from the aperture.

The exemplary knob 50 (FIG. 4) has a lower portion 120 extending upward from a lower rim 122 and merging with an intermediate portion 124. The intermediate portion joins the lower portion to the screw shaft. The exemplary intermediate portion 124 (FIG. 14). The exemplary intermediate portion 124 comprises a perimeter portion 126 and a plurality of radial webs 128 extending inward to merge at a root of the shaft and leaving openings 130 between the webs 128. With this exemplary configuration, it is desirable to plug or close the openings 130 to prevent leakage and limit air access to the material. Accordingly, a seal 140 may be provided. The exemplary seal 140 is formed as a disk serving as a plug and is captured by an inwardly directed bead 142 or other projection in the knob. Alternative seals include adhesive foils and the like.

The exemplary barrel pieces, screw, platform, plug, and cap are each injection molded. Exemplary barrel, cap, screw, and plug material is polypropylene; and platform material is polyethylene. Such molding and assembly may be via conventional techniques.

In an exemplary sequence of manufacture, the components are all individually molded. One exemplary initial sub-assembly step involves assembling the outer barrel, the screw/knob and the platform. In one example, the platform 28 is put in place at the bottom of the outer barrel 24-2 held by a tool (not shown) extending inward through the open upper end of the barrel. The screw is then inserted tip-first through the opening in the lower end of the outer barrel and threaded into the platform. Eventually, as the screw nears bottoming out, the screw will draw the screw and platform toward each other in a final stage. In this stage, the screw snaps into retained engagement with the outer barrel.

The exemplary retained engagement is initiated by the underside 160 of the platform (as shown the underside of the perimeter portion 40) being supported by the upper rim 176 of outer barrel inner wall.

Figure 12:
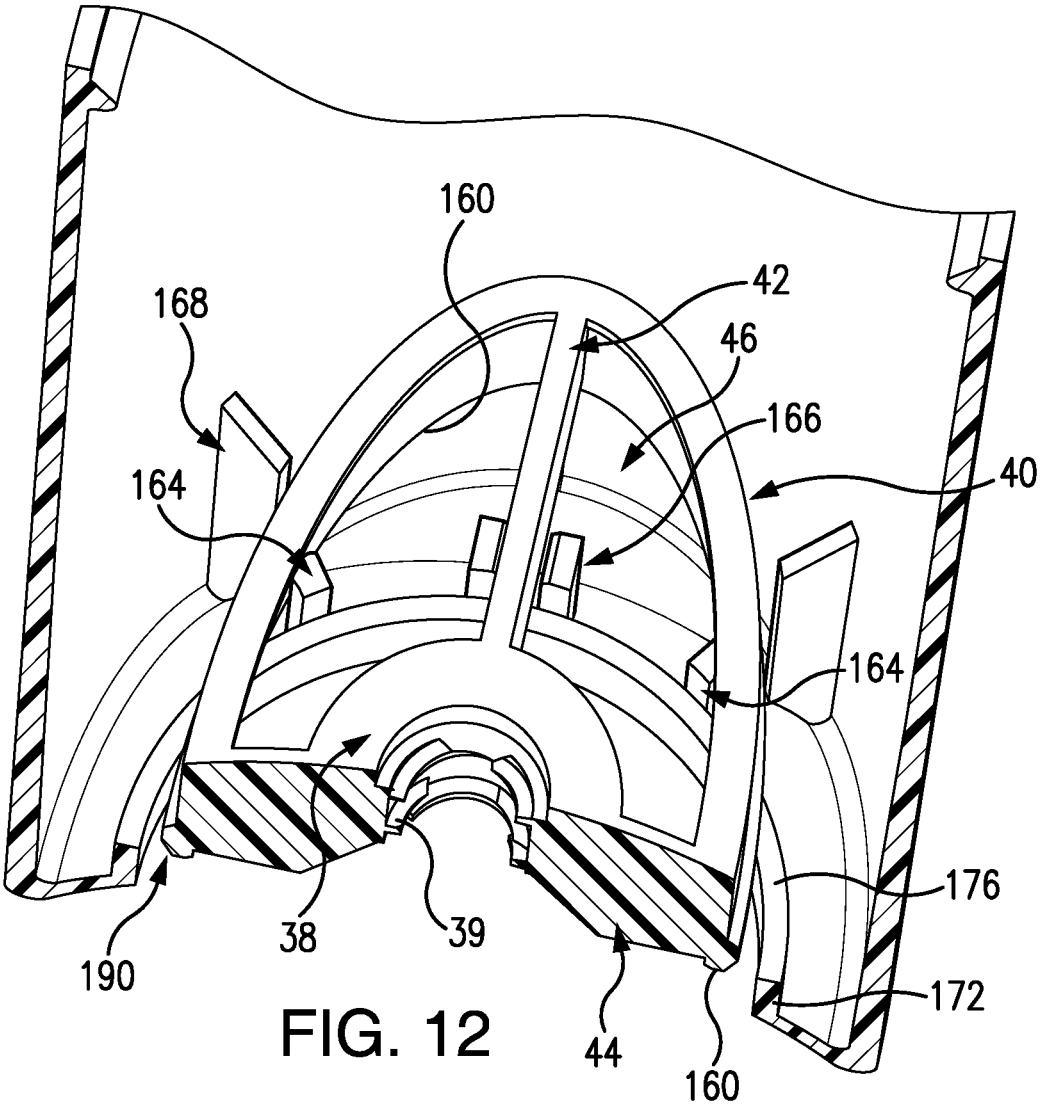
FIG. 12 is a first cutaway view of a lower portion of the dispenser in a first stage of assembly.
Figure 13:
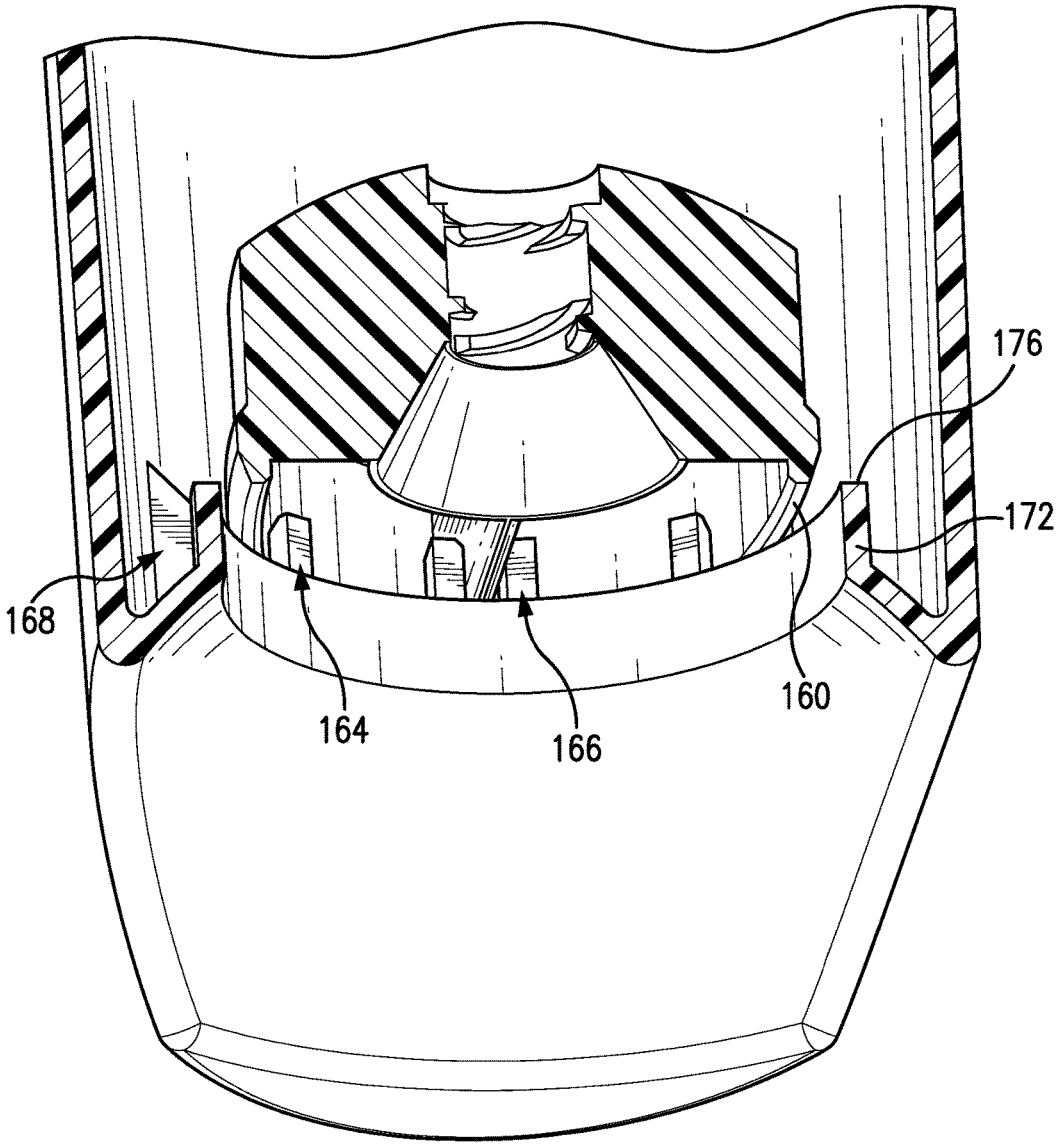
FIG. 13 is a second cutaway view of the lower portion of FIG. 12.

The knob portion of the screw has an upper arcuate (domed) camming surface 170 (FIG. 4) which contacts the periphery of the aperture/opening in the outer barrel (e.g., along an inner sidewall 172 of the outer barrel) and expands it during the final stage of screwing action. At a lower/outboard end of the camming surface, the camming surface and underside forms a radially protruding barb 174 which passes over an upper rim 176 of the inner sidewall of the outer barrel and snaps into engagement therewith to retain the screw against downward retraction. The screw is retained against upward retraction by close interfitting of the inboard portion of the gripping section of the knob with a concave surface 180 of a compartment in the barrel outer member underside adjacent the aperture. FIG. 12 shows the underside 160 of the perimeter portion supported atop the inner sidewall upper rim 176 prior to screw installation. It also shows one of several pairs of post-like ribs 166 capturing the associated webs 42 and/or 44 so as to angularly orient and optionally centrally position the platform for receiving the screw. Additional centering vertical ribs 164 are also shown. Additional webs 168 may extend up along the outer sidewall of the outer barrel and may have inner edges helping to orient and/or center the bottomed platform and/or structurally reinforce the outer barrel.

With whatever tool held the platform removed, the inner barrel 24-1 may then be installed (e.g., via a downward translation). Nearing a lower end of its movement, a lower portion of the inner surface of the inner wall of the inner barrel will come into contact with an outwardly protruding wiper bead 190 (FIG. 12 and FIG. 4) near the bottom of the platform to provide a seal between the elevator and inner barrel and maintain precise alignment. In this final stage of insertion of the inner barrel, the inner barrel may come into snap fit engagement with the outer barrel. Exemplary engagement comprises complementary surfaces near the upper end of the outer barrel outer wall and near the lower end of the inner barrel outer wall. In the illustrated example, the outer barrel outer wall, adjacent its upper rim, bears an annular barb 87 and the inner barrel outer wall near its lower rim bears an outwardly open circumscribing channel 84. The channel captures the barb and prevents upward extraction of the inner barrel.

One may, optionally, at this point cap the barrel. The cap 25 is downwardly inserted and may have a snap fit detented extractable engagement (not shown) with the outer surface of the outer wall of the inner barrel in an otherwise conventional matter.

In a further variation, the scent preview/indicator window 82 may be temporarily covered prior to cap installation. For example, a polymer film adhesive-backed label may be applied over the window to seal the window during storage and transport prior to use. The adhesive may be readily removable so that, in a retail environment, a potential consumer can open the cap and at least temporarily remove the label to expose the window and facilitate scent preview. The retail life cycle is typically short enough so that even if the seal is not replaced, the product will not have time to dry out.

In order to fill, the package may be placed in an inverted orientation if not already so. The filling nozzle(s) (not shown) may extend through apertures 130 inboard of the camming surface of the screw member and through apertures 46 (or near enough to deliver through) in the platform outboard of its central threaded boss 38. The nozzle may deliver the product to a desired fill level. Delivery may be performed at elevated temperature whereafter the product may cool to solidify.

Thereafter, in order to minimize possible leakage, the holes 130 in the screw member may be sealed (e.g., via placing a circular plug or molded plastic disk 140 into a compartment at the upper end of the domed lower portion 120 of finger-engaging wheel/knob). The exemplary compartment has an annular bead 142 allowing snap engagement of the molded plastic disk. Alternative sealing may involve an adhesive foil or film.

One or more embodiments of the present invention have been described. Nevertheless, it will be understood that various modifications may be made without departing from the spirit and scope of the invention. For example, when implemented in the context of an existing applicator or a modification of an existing applicator, details of such existing applicator may influence details of any particular implementation. Accordingly, other embodiments are within the scope of the following claims.

What is claimed is:

1. A dispenser comprising:
- a barrel having: a bottom end; a top end; an inner wall; and an outer wall;
- a platform upwardly moveable within the barrel inner wall from a first position to a second position;
- a screw member coupled to the platform to shift the platform upward and comprising:
  - a threaded first portion engaged to the platform for relative rotation about a first axis; and
  - a second portion; and
- a cap having a first condition mounted at the barrel top end and a removed condition, wherein:
- an upper portion of the dispenser comprises a rim portion having a rim;
- the barrel outer wall has an aperture below the rim; and
- in the first condition the cap covers the aperture.

2. The dispenser of claim 1 wherein the barrel comprises:
- a first member forming the inner wall and an upper portion of the outer wall including the aperture; and
- a second member assembled to the first member and forming a lower portion of the outer wall.

3. The dispenser of claim 1 further comprising :
- a label over the aperture to seal the aperture during storage and transport prior to use.

4. The dispenser of claim 3 wherein:
- the label is a polymer film label.

5. The dispenser of claim 3 wherein:
- the label is an adhesive-backed label.

6. The dispenser of claim 3 wherein:
- the label is a polymer film adhesive-backed label.

7. The dispenser of claim 1 wherein:
- the aperture is at least 3 mm high and 3 mm wide.

8. The dispenser of claim 1 the upper portion comprises:
- a dome;
- a breakaway connection between the dome and the rim portion; and
- a handle coupled to the dome to allow pulling of the handle to sever the breakaway connection to remove the dome from the rim portion.

9. The dispenser of claim 8 wherein:
- the breakaway connection is recessed along a region of at least 300 degrees around the axis.

10. The dispenser of claim 8 wherein:
- the breakaway connection is recessed along a region of a full 360 degrees around the axis.

11. The dispenser of claim 8 wherein:
- the breakaway connection is less than 0.5 mm thick.

12. The dispenser of claim 8 wherein:
- the breakaway connection is recessed below the rim by at least 1 mm.

13. The dispenser of claim 8 wherein:

the breakaway connection is recessed below the rim by 1.2-2.0 mm.

14. The dispenser of claim 8 wherein:

the dome is generally elliptical in planform.

15. The dispenser of claim 8 wherein:

the dome is generally upwardly doubly convex.

16. The dispenser of claim 8 wherein:

the rim portion, dome, breakaway connection, and handle are unitarily molded as a single piece.

17. The dispenser of claim 16 wherein:

the single piece is of uniform composition along the rim portion, dome, breakaway connection, and handle.

18. The dispenser of claim 8 wherein:

the barrel bottom end, along front and back, has respective relieved areas; and the relieved areas accommodate a knob coupled to the screw member threaded portion.

19. The dispenser of claim 8 further comprising:

a body of a personal care composition at least partially within the barrel between the platform and the top end.

20. A method for using the dispenser of claim 8, the method comprising:

removing the cap;

pulling on the handle to sever the breakaway connection and remove the dome; and rotating the screw relative to the body in the first direction so as to raise the platform and drive the body of personal care composition from the barrel upper end.

21. A dispenser comprising:

a barrel having: a bottom end; a top end; an inner wall; and an outer wall;

a platform upwardly moveable within the barrel inner wall from a first position to a second position;

a screw member coupled to the platform to shift the platform upward and comprising:

a threaded first portion engaged to the platform for relative rotation about a first axis; and a second portion; and a cap having a first condition mounted at the barrel top end and a removed condition, wherein:

the barrel has dispensing aperture or a tearaway dome for forming a dispensing aperture;

the barrel outer wall has an aperture below said dispensing aperture or tearaway dome; and in the first condition the cap covers the aperture.

* * * * *